US005596768A

United States Patent [19]

Wang

[11] Patent Number: 5,596,768

[45] Date of Patent: Jan. 28, 1997

[54] ATHLETIC PROTECTIVE GEAR WITH CONCEALED FASTENING ELEMENTS

[76] Inventor: Hudson Wang, No. 20, Lane 1068, Feng-Lin-Erh Rd., Lin-Yuan Hsiang, Kaohsiung Hsien, Taiwan

[21] Appl. No.: 578,341

[22] Filed: Dec. 26, 1995

[51] Int. Cl.[6] ..... A41D 13/00

[52] U.S. Cl. ..... 2/462; 2/908

[58] Field of Search ..... 2/2, 2.11, 16, 22, 2/44, 45, 267, 908, 910, 911, 912, 920

[56] References Cited

U.S. PATENT DOCUMENTS 4,370,754 2/1983 Donzis ..... 2/2

5,060,313 10/1991 Neuhafen ..... 2/2

*Primary Examiner*—C. D. Crowder

*Assistant Examiner*—Larry D. Worrell, Jr.

*Attorney, Agent, or Firm*—Fitzpatrick, Cella, Harper & Scinto

[57] ABSTRACT

An athletic protective gear includes a protective structural member, a protective pad, and a retainer unit. The structural member is formed to overlie a body part to be protected. The protective pad of depressible material is formed to be disposed between the protective structural member and the body part and has two openings formed therethrough. The retainer unit includes a fastener strap secured on an inner surface of the protective structural member and has two opposed end portions which respectively extend through the openings of the structural member, and two hook-and-loop elements which are secured to the end portions respectively and which engage each other in such a manner that the protective structural member abuts against an outer side surface of the protective pad, thereby retaining the end portions of the strap on an inner side surface of the protective pad. Thus, the protective pad is confined between the structural member and the body part. An external article or a person cannot impact directly the elements so as to prevent untimely removal of the hook-and-loop elements from each other.

1 Claim, 5 Drawing Sheets

ATHLETIC PROTECTIVE GEAR WITH CONCEALED FASTENING ELEMENTS

BACKGROUND OF THE INVENTION

1. Field of the Invention

The invention relates to a protective gear, more particularly to an athletic protective gear for use in sports, e.g. in American football.

2. Description of the Related Art

U.S. Pat. No. 4,554,681 discloses a conventional athletic protective gear, as illustrated in FIG. 1, which is usually worn by an American football player and which includes a protective structural member 10 formed to overlie a body part (not shown) to be protected, a protective pad 12 made from depressible material and disposed between the protective structural member 10 and the body part (not shown), and four retainer units 11, each of which has a structure shown in FIG. 2. As illustrated in FIG. 2, in each of the retainer units 11, the structural member 10 has two openings 100 formed therethrough. A fastener strap 120 is secured on the protective pad 12 and has two opposed end portions 122, 124 which extend respectively through the openings 100 of the structural member 10, and two hook-and-loop elements 123 which are secured to the end portions 122, 124 respectively and which engage each other so as to retain the end portions 122, 124 on the external surface of the structural member 10. Thus, the protective pad 12 is confined between the structural member 10 and the body part (not shown).

A drawback of the conventional athletic protective gear is that the end portions 122, 124 of the strap 120 may be impacted directly during a match, thereby resulting in disengagement of the hook-and-loop elements 123 from each other.

SUMMARY OF THE INVENTION

The object of this invention is to provide an athletic protective gear with a retainer unit which interconnects the structural member and the protective pad in such a manner that the retainer unit cannot be directly impacted during a match, thereby avoiding disengagement of the structural member from the protective pad.

Accordingly, the athletic protective gear of this invention includes a protective structural member, a protective pad, and a retainer unit. The structural member is formed to overlie a body part to be protected. The protective pad of depressible material is formed to be disposed between the protective structural member and the body part, and has two openings formed therethrough. The retainer unit includes a fastener strap secured on an inner surface of the protective structural member and has two opposed end portions which extend through the openings respectively, and two hook-and-loop elements which are secured to the end portions respectively and which engage each other in such a manner that the protective structural member abuts against an outer side surface of the protective pad, thereby retaining the end portions on an inner side surface of the protective pad. Thus, the protective pad is confined between the structural member and the body part. Accordingly, an external article or a person cannot impact directly the elements so as to prevent untimely removal of the hook-and-loop elements from each other.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENT

Figure 3:
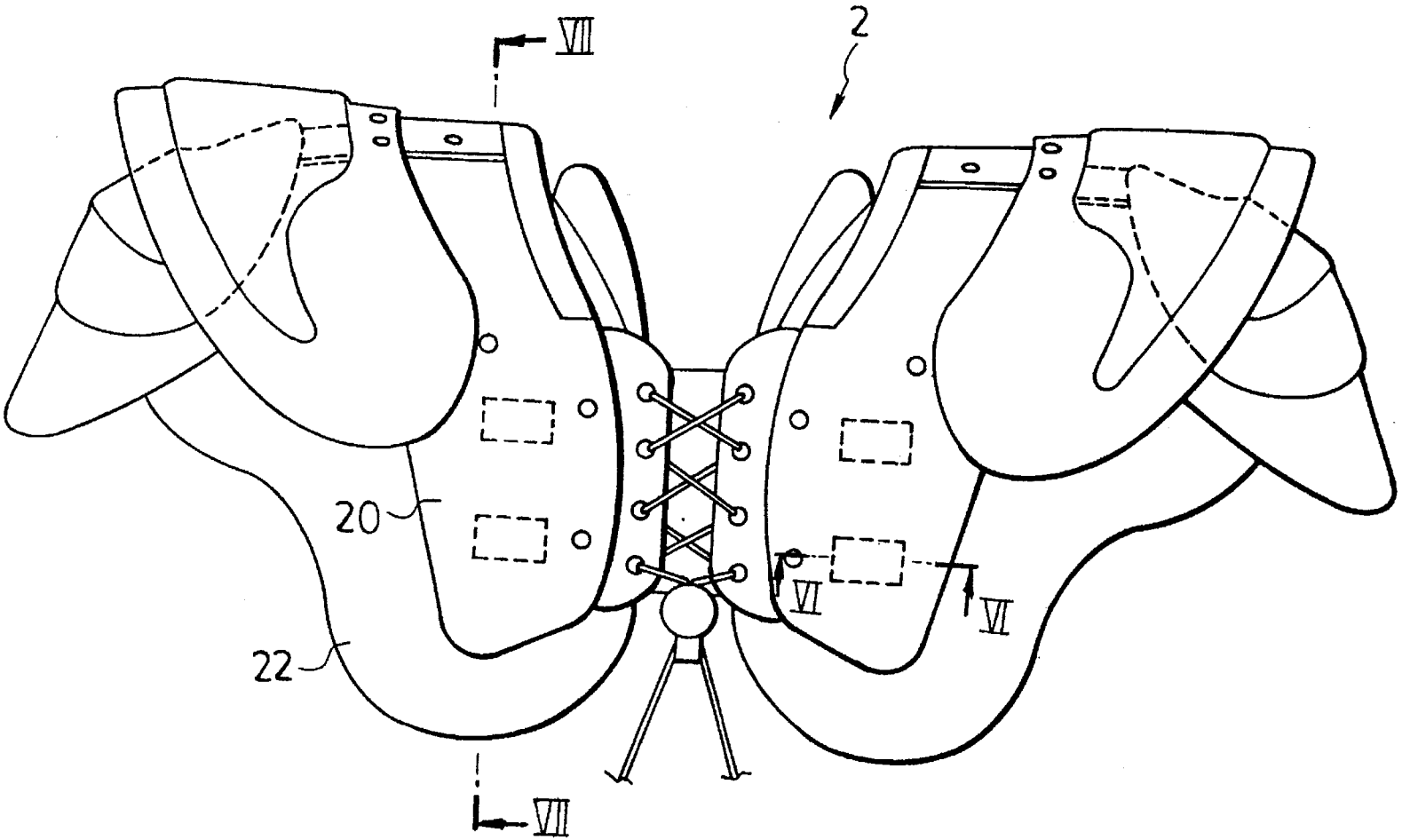
FIG. 3 is an elevational view of an athletic protective gear of this invention.
Figure 6:
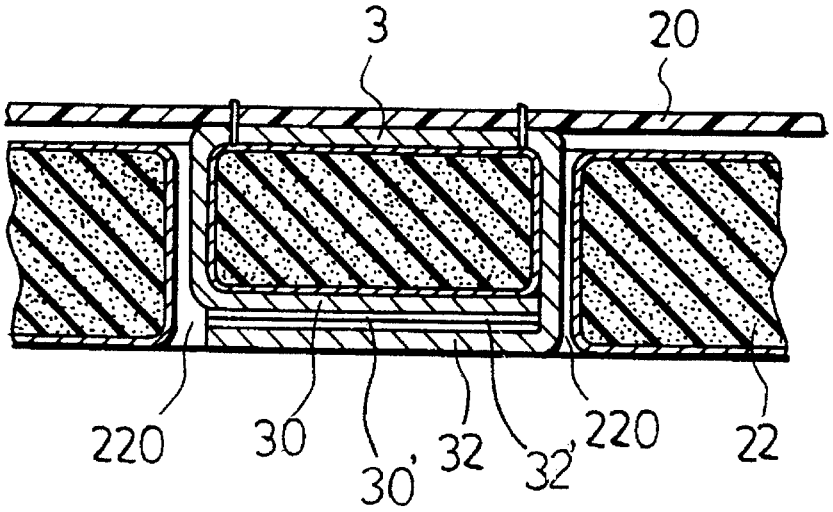
FIG. 6 is a sectional view of the protective gear of this invention, taken along line VI—VI in FIG. 3.

Referring to FIG. 3, an athletic protective gear 2 of this invention includes a protective structural member 20, a protective pad 22, and four retainer units, each of which includes a fastener strap 3, as illustrated in FIG. 6.

Figure 1:
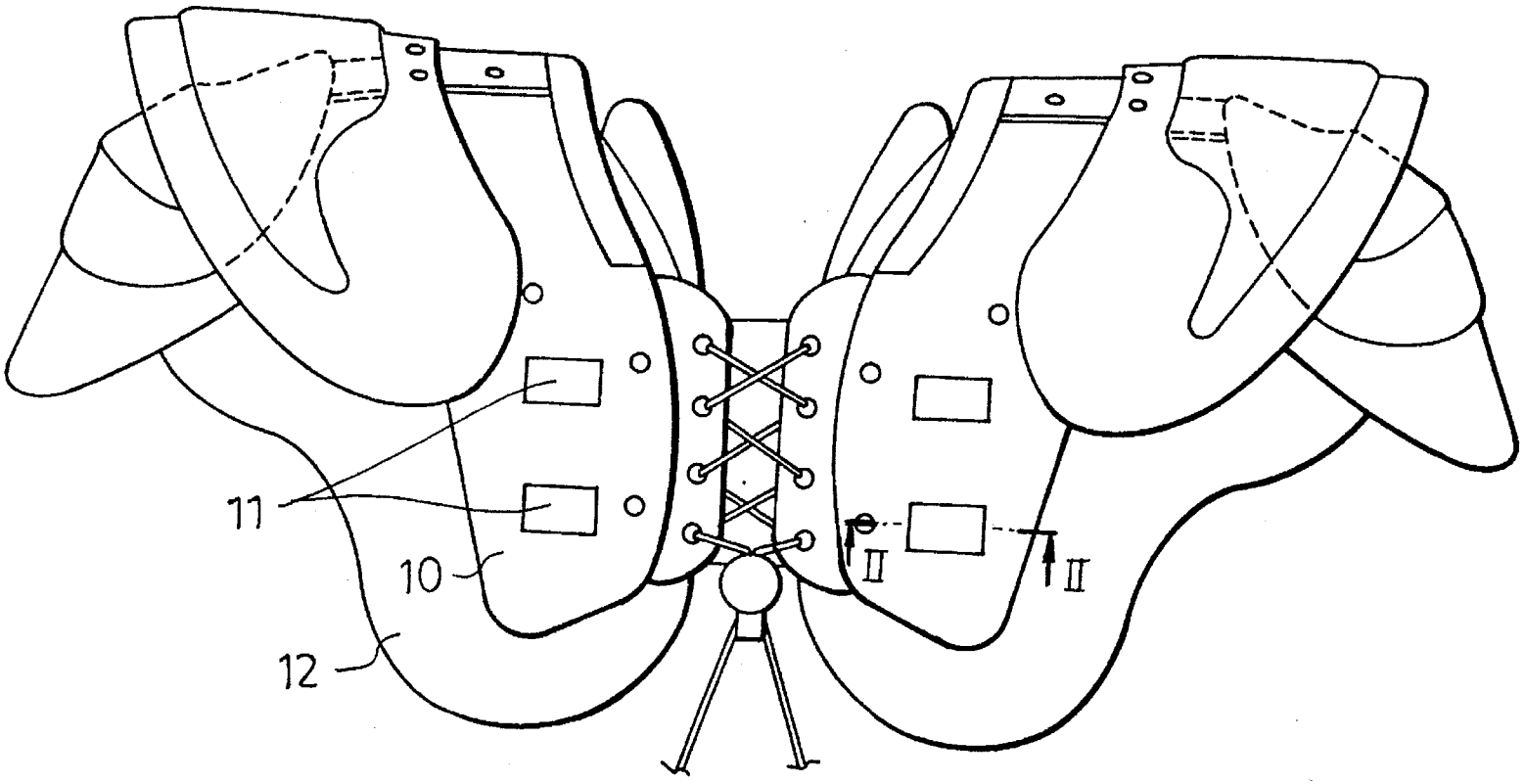
FIG. 1 (PRIOR ART)
FIG. 1 is an elevational view of a conventional athletic protective gear disclosed in U.S. Pat. No. 4,554,681.
Figure 2:
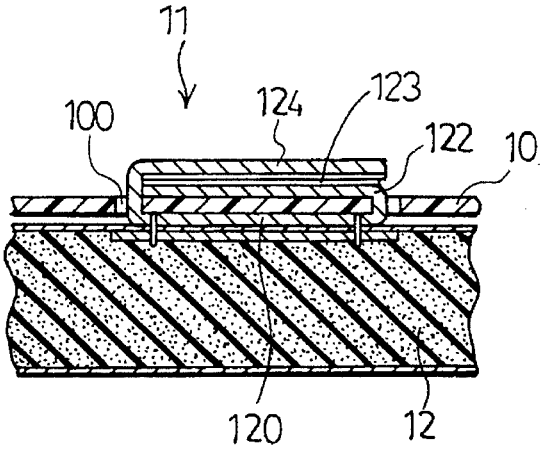
FIG. 2 (PRIOR ART)
FIG. 2 is a sectional view of the conventional athletic protective gear taken along line II—II in FIG. 1.
Figure 4:
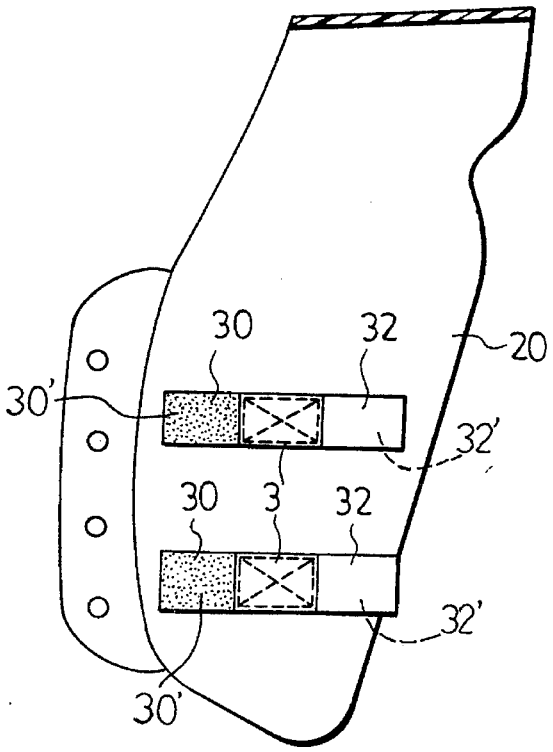
FIG. 4 shows how a fastener strap is mounted on a protective structural member of the protective gear of this invention.

As illustrated in FIG. 4, each of the fastener straps 3 is secured on an inner surface of the protective structural member 20 and has two opposed end portions 30, 32, and two hook-and-loop elements 30', 32' (see FIG. 6) secured to the end portions 30, 32, respectively.

Figure 5:
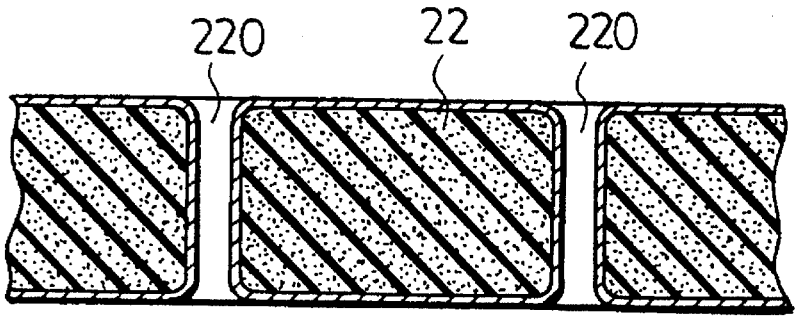
FIG. 5 shows a sectional view of a protective pad of the protective gear of this invention.
Figure 7:
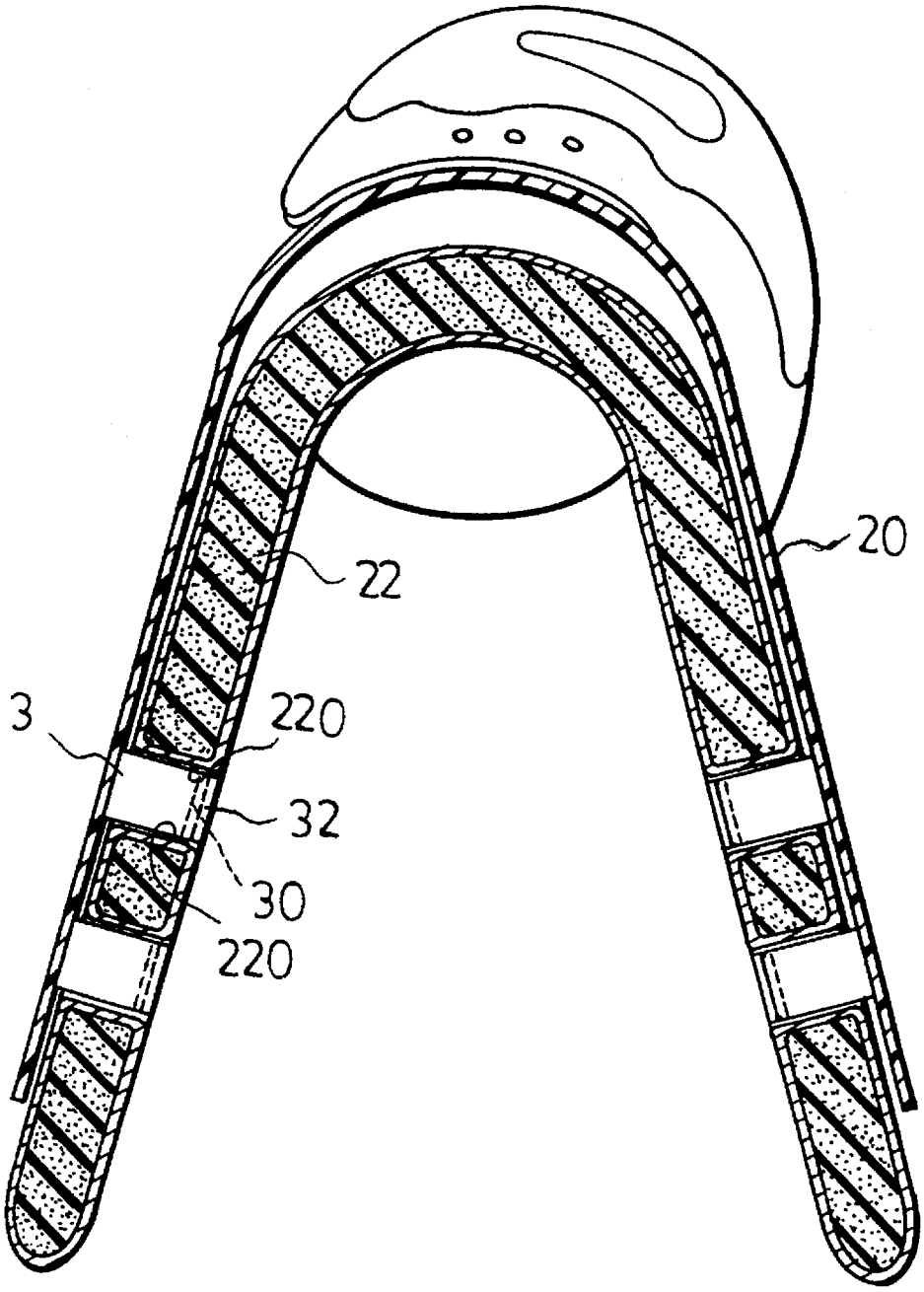
FIG. 7 is a sectional view of the protective gear of this invention, taken along line VII—VII in FIG. 3.

Referring to FIGS. 5 and 6, the protective structural member 20 is formed to overlie a body part (not visible) to be protected. The protective pad 22 is made from depressible material and is disposed between the protective structural member 20 and the body part (not shown). Two openings 220 are formed through the protective pad 22. As illustrated in FIG. 7, the end portions 30, 32 of the strap 3 extend through the openings 220 of the protective pad 22 and engage each other in such a manner that the protective structural member 20 abuts against the outer side surface of the protective pad 22 so as to retain the end portions 30, 32 on the inner side surface of the protective pad 22 (see FIG. 6). Accordingly, the protective pad 22 is confined between the structural member 20 and the body part (not shown).

An external article or a person cannot impact directly the end portions 30, 32 of the strap 3 during a football match so as to prevent untimely removal of the hook-and-loop elements 30', 32' from each other. This results in longer service life of the athletic protective gear of this invention.

With this invention thus explained, it is obvious to those skilled in the art that various modifications and variations can be made without departing from the scope and spirit thereof. It is therefore intended that the invention be limited only as in the appended claims.

I claim:

1. An athletic protective gear comprising:

a protective structural member adapted to overlie a body part to be protected;

a protective pad of depressible material adapted to be disposed between said protective structural member and the body part and having two openings formed therethrough; and a fastener strap secured on an inner surface of said protective structural member and having two opposed end portions extending through said openings respectively, and two hook-and-loop elements which are secured to said end portions respectively and which engage each other in such a manner that said protective structural member abuts against an outer side surface of said protective pad, so as to retain said end portions on an inner side surface of said protective pad, thereby confining said protective pad between said structural member and said body part;

whereby, a person cannot impact directly said elements so as to prevent untimely removal of said hook-and-loop elements from each other.

* * * * *